US010639659B1

(12) United States Patent
Gutekunst et al.

(10) Patent No.: US 10,639,659 B1
(45) Date of Patent: May 5, 2020

(54) BACKPACK SPRAYER WITH INTERNAL PUMP

(71) Applicant: Chapin Manufacturing, Inc., Batavia, NY (US)

(72) Inventors: Greg Gutekunst, East Aurora, NY (US); David Dubiel, N. Chili, NY (US)

(73) Assignee: Chapin Manufacturing, Inc., Batavia, NY (US)

( * ) Notice: Subject to any disclaimer, the term of this patent is extended or adjusted under 35 U.S.C. 154(b) by 0 days.

(21) Appl. No.: 16/352,121

(22) Filed: Mar. 13, 2019

(51) Int. Cl.
*B05B 9/08* (2006.01)

(52) U.S. Cl.
CPC ..... *B05B 9/0822* (2013.01)

(58) Field of Classification Search
CPC ..... B05B 9/08; B05B 9/0805; B05B 9/0877; B05B 9/0883; B05B 9/0888
See application file for complete search history.

(56) References Cited

U.S. PATENT DOCUMENTS

| | | | | |
|---|---|---|---|---|
| 4,008,984 | A * | 2/1977 | Scholle | F01L 21/02 417/393 |
| 5,636,791 | A | 6/1997 | Leer | |
| 5,984,199 | A | 11/1999 | Restive | |
| 7,007,826 | B2 | 3/2006 | Shapanus et al. | |
| D609,773 | S | 2/2010 | Abernethy et al. | |
| D633,984 | S | 3/2011 | Plantz | |
| 8,616,466 | B2 | 12/2013 | Strauss et al. | |
| D755,926 | S | 5/2016 | Wirz Luchsinger | |
| D760,350 | S | 6/2016 | Wirz Luchsinger | |
| 9,358,563 | B2 | 6/2016 | Kennemer et al. | |
| D809,626 | S | 2/2018 | Bonaventura et al. | |
| 2006/0261181 | A1 | 11/2006 | Wirz | |
| 2015/0296764 | A1 | 10/2015 | Wirz Luchsinger | |
| 2017/0266621 | A1 * | 9/2017 | Barchet | C02F 1/002 |

FOREIGN PATENT DOCUMENTS

| | | |
|---|---|---|
| AU | 6452796 | 2/1997 |
| CA | 2532258 | 1/2005 |
| MX | 344075 | 12/2016 |

* cited by examiner

*Primary Examiner* — Donnell A Long
(74) *Attorney, Agent, or Firm* — Woods Oviatt Gilmann LLP; Katherine H. McGuire, Esq.

(57) ABSTRACT

An internal pump backpack sprayer system includes first and second tanks and a double action pump unit. The first tank defines an open volume to hold a fluid. The second tank is received within the first tank and receives a pressurized fluid therein. The double action pump includes a cylinder and piston assembly having a cylinder housing with first and second inlets and first and second outlets. A piston is located and moveable within a cylinder. When the piston moves in an up-stroke, a first portion of the fluid is drawn from the first tank through the first inlet while the pressurized fluid is discharged to the second tank through the second outlet. When the piston moves in a down-stroke, a second portion of the fluid is drawn from the first tank through the second inlet while the pressurized fluid is discharged to the second tank through the first outlet.

9 Claims, 8 Drawing Sheets

BACKPACK SPRAYER WITH INTERNAL PUMP

FIELD OF THE INVENTION

The present invention generally relates to sprayers, and more particularly to a backpack style sprayer, and still more particularly to a manually actuated backpack style sprayer having an internal pump.

BACKGROUND OF THE INVENTION

Sprayers, such as backpack sprayers are used across an array of applications, including farms, golf courses and residential properties, to apply water or other liquids, such as fertilizers or pesticides including herbicides, insecticides and the like. As the name implies, backpack sprayers are designed to be worn by the user, such as through securing a tank of the sprayer against the user's back via one or more shoulder straps. A handheld spray wand is fluidly coupled to the tank and is manually actuated, such as through a trigger, to dispense fluid from the tank through the spray wand. To pressurize the fluid for delivery to the wand, backpack sprayers include a pump and may be configured as battery powered pump sprayers or manually actuated pump sprayers.

Typically, manually actuated pump sprayers include pump units suspended beneath the spray tank. A support stand may be included with the backpack to prevent resting of the pump unit on the ground when the sprayer is not being worn. Nevertheless, because the pump unit is located externally of the spray tank, the various moving components of the pump unit are susceptible to impact damage and contamination due to dust and dirt. While backpack sprayers have been engineered to incorporate the pump unit with the body of the tank housing, such sprayers require complex plumbing, are susceptible to seal failures and are difficult to clean and maintain.

A further drawback of manually actuated internal pump sprayers is inefficiency of the pumping mechanism. That is, internal pump sprayers use a single action piston pump to pressurize fluid from the spray tank into the pump's pressure vessel. As a result, actuation of the pump handle pressurizes fluid only on either the up-stroke or down-stroke of the piston. A further consequence is the need for a relatively large-sized piston and cylinder to move a useful amount of liquid per stroke cycle. However, handle force to actuate the pump increases as a result of cylinder diameter. Thus, a large piston and cylinder requires a higher pumping force applied to the handle. The need to provide such a pumping force may lead to user fatigue. Also, the maximum pressure a fluid within the pressure vessel can reach is limited by the amount of handle force required. As a result, large piston and cylinder pumps have decreased operating fluid pressures.

Thus, there remains a need for a backpack sprayer with in an internal pump that is more easily plumbed, operated and cleaned, as well as being more efficient while requiring less handle force. The present invention satisfies this as well as other needs.

SUMMARY OF THE INVENTION

In view of the above and in accordance with an aspect of the present invention, the present invention is generally directed to an internal pump backpack sprayer system comprising first and second tanks and a double action pump unit. The first tank includes a tank housing defining an open internal volume configured to hold a fluid therein. The second tank is dimensioned to be received within the internal volume of the first tank and is configured to receive a pressurized fluid therein. The double action pump unit is received within the internal volume of the first tank and is fluidly coupled to the first tank and the second tank. The pump unit is configured to receive the fluid from the first tank and deliver the pressurized fluid to the second tank.

The pump unit comprises a cylinder and piston assembly and a piston rod. The cylinder and piston assembly comprises a cylinder housing, a piston, a cylinder head, a pump manifold, an inlet check valve assembly and an outlet check valve assembly. The piston rod is coupled to the piston at a first end of the piston rod.

The cylinder housing has an inlet tube wall defining an inlet tube, an outlet tube wall defining an outlet tube, an inner cylinder wall defining a cylinder, and a bottom wall including an inlet tube orifice coinciding with the inlet tube, an outlet tube orifice coinciding with the outlet tube and a cylinder inlet orifice and cylinder outlet orifice coinciding with the cylinder. The cylinder housing has a top end located opposite the bottom wall. The piston is located and moveable within the cylinder.

A first pressure chamber is defined within the inner cylinder wall between the bottom wall of the cylinder housing and the piston. The cylinder head is located at the top end of the cylinder housing. A second pressure chamber is defined with the inlet tube, the outlet tube and the inner cylinder wall between the piston and the cylinder head. The pump manifold is secured to the bottom wall of the cylinder housing and includes an inlet well fluidly separated from an outlet well. The inlet well includes an inlet orifice in fluid communication with the first tank and the outlet well includes an outlet orifice in fluid communication with the second tank. The inlet check valve assembly is located in the inlet well and includes an inlet check valve housing, an inlet tube check valve and a cylinder inlet check valve. The outlet check valve assembly is located in the outlet well and includes an outlet check valve housing, an outlet tube check valve and a cylinder outlet check valve.

During an up-stroke of the piston within the cylinder, the inlet tube check valve and the cylinder outlet check valve are closed and the cylinder inlet check valve and the outlet tube check valve are open. A vacuum is formed in the first pressure chamber to draw fluid from the first tank into the first pressure chamber through the inlet orifice in the pump manifold and the cylinder inlet orifice. Pressurized fluid within the second pressure chamber is discharged from the outlet tube to the second tank through the outlet tube orifice and the outlet orifice in the pump manifold.

During a down-stroke of the piston within the cylinder, the inlet tube check valve and the cylinder outlet check valve are open and the cylinder inlet check valve and the outlet tube check valve are closed. Pressurized fluid within the first pressure chamber is discharged from the cylinder to the second tank through the cylinder outlet orifice and the outlet orifice in the pump manifold and a vacuum is formed in the second pressure chamber to draw fluid from the first tank into the second pressure chamber through the inlet orifice in the pump manifold and the inlet tube orifice.

Additional objects, advantages and novel aspects of the present invention will be set forth in part in the description which follows, and will in part become apparent to those in the practice of the invention, when considered with the attached figures.

DETAILED DESCRIPTION OF THE PREFERRED EMBODIMENTS

Figure 1:
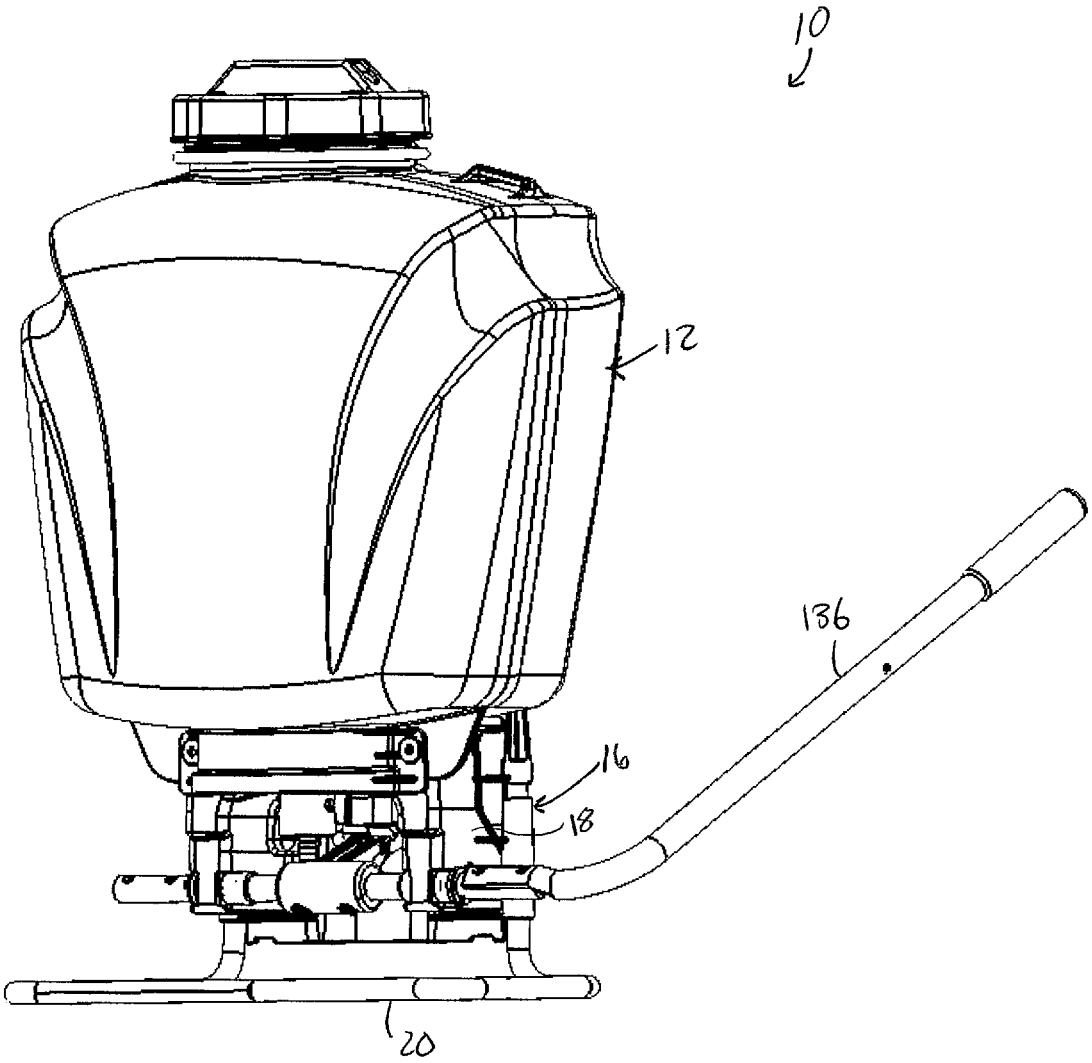
FIG. 1 is a front perspective view of a sprayer system in accordance with an aspect of the present invention.
Figure 2:
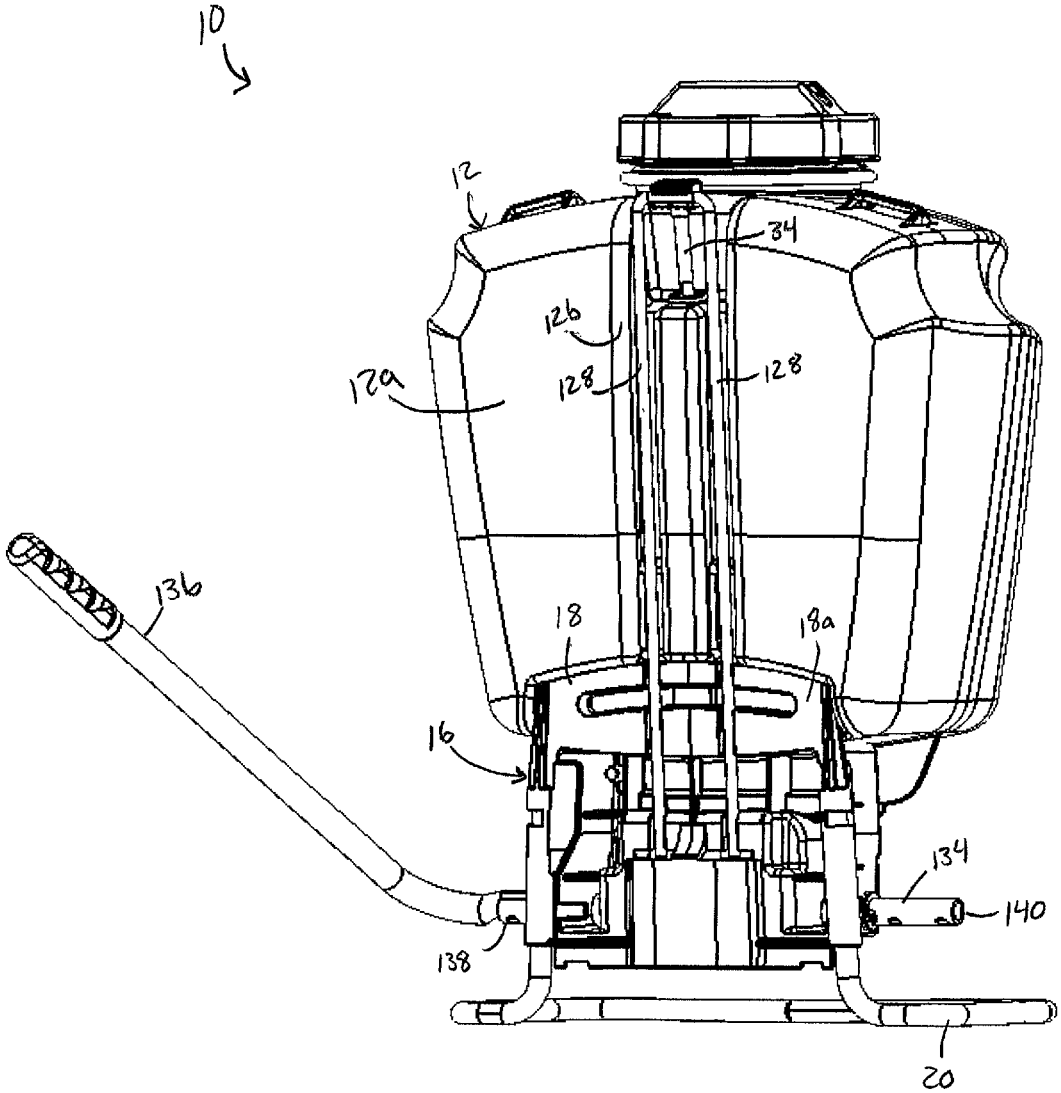
FIG. 2 is a rear perspective view of the sprayer system shown in FIG. 1.
Figure 3:
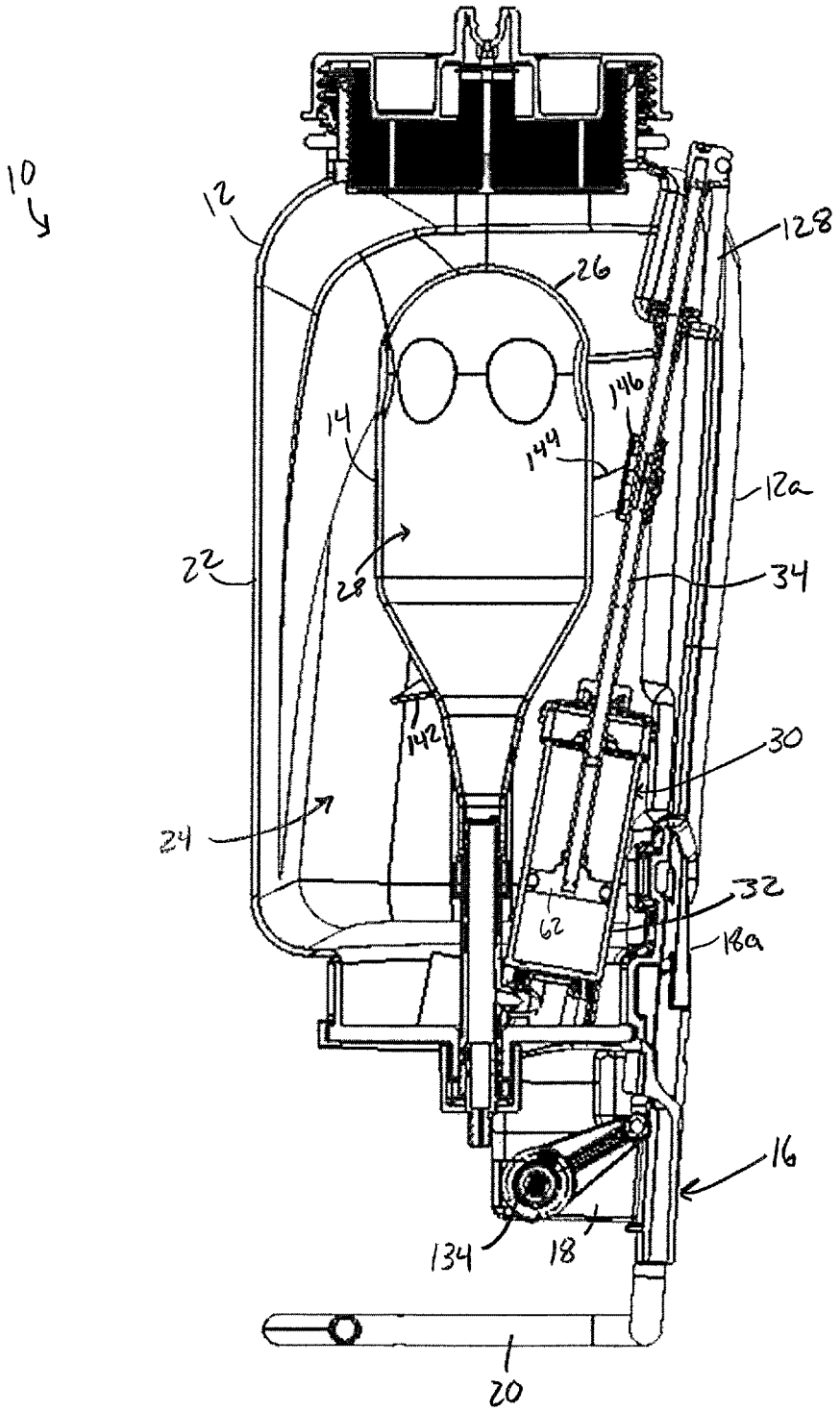
FIG. 3 is a side cross section view of the sprayer system shown in FIGS. 1 and 2.

Referring now to the drawings, and with particular reference to FIGS. 1-3, in accordance with an aspect of the present invention, a backpack sprayer system 10 may generally comprise a first tank 12 and a second tank 14 mounted onto a modular backpack frame 16. Modular backpack frame 16 may comprise a frame plate 18 and support member 20, such as that shown and described within commonly owned U.S. patent application Ser. No. 16/351,882 filed on Mar. 13, 2019, the entirety of which is hereby incorporated by reference. Rear wall 12*a* of first tank 12 and rear surface 18*a* for frame plate 18 may each have a curved profile so as to more ergonomically rest against a user's back during use. First tank 12 includes a first tank housing 22 which defines an open internal volume 24 which receives a spray fluid, such as water or dilute chemical solution, therein. Second tank 14 is dimensioned to be received within open internal volume 24. Second tank 14 includes a second tank housing 26 defining a pressurized fluid chamber 28 which is configured to receive a pressurized fluid therein, as will be described in greater detail below.

Figure 4:
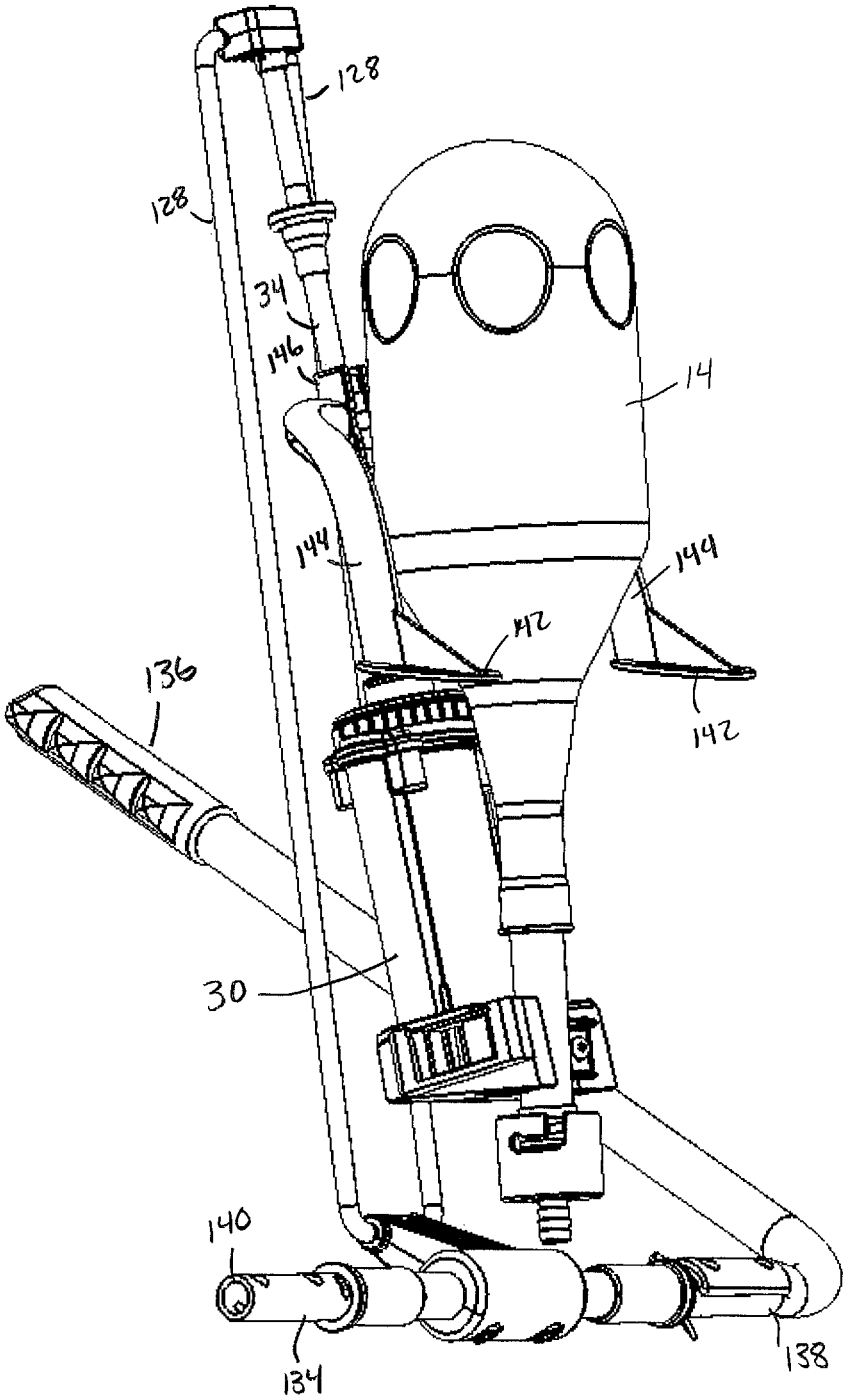
FIG. 4 is a perspective view of the sprayer system shown in FIGS. 1 and 2 with the spray tank and backpack frame removed.

With reference to FIGS. 3 and 4, first tank 12 and second tank 14 are each individually fluidly coupled to an internal pump unit 30 resident within open internal volume 24 of first tank housing 22. With additional reference to FIGS. 5-8, and in accordance with an aspect of the present invention, pump unit 30 is configured as a double action piston pump generally comprising a cylinder and piston assembly 32 and piston rod 34. By way of example and without limitation thereto, cylinder and piston assembly 32 may include a cylinder housing 36 having an inlet tube wall 38 defining an inlet tube 40, an outlet tube wall 42 defining an outlet tube 44, an inner cylinder wall 46 defining a cylinder 48, and a bottom wall 50 including an inlet tube orifice 52 coinciding with the inlet tube 40, an outlet tube orifice 54 coinciding with the outlet tube 44 and a cylinder inlet orifice 56 and cylinder outlet orifice 58 coinciding with the cylinder 48. Cylinder housing 36 also has a top end 60 located opposite bottom wall 50.

A piston 62 is located and moveable within cylinder 48 such that a first pressure chamber 64 is defined within inner cylinder wall 46 between bottom wall 50 of cylinder housing 36 and piston 62. Piston rod 34 is coupled to piston 62 at a first end 66 of piston rod 34. Cylinder head 68 is located at top end 60 of cylinder housing 36 and includes an aperture 70 so as to allow passage of piston rod 34 therethrough. A second pressure chamber 72 is defined within inlet tube 40, outlet tube 44 and inner cylinder wall 46 between piston 62 and cylinder head 68. A cylinder collar and seal 74 is coupled to cylinder head 68 and forms a fluid-tight seal about piston rod 34 to prevent fluid leaking from second pressure chamber 72 about piston rod 34.

Figure 5:
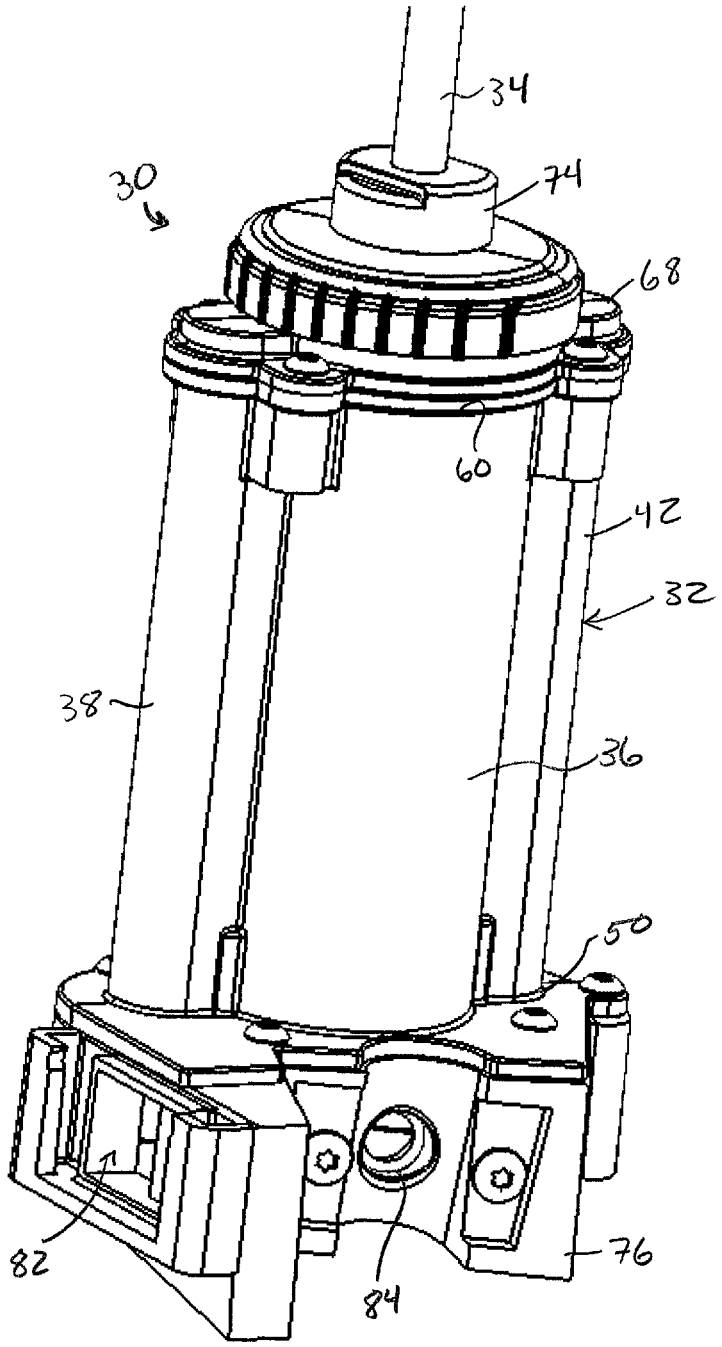
FIG. 5 is an expanded view of a double action pump unit used within the sprayer system shown in FIGS. 1 and 2.
Figure 6:
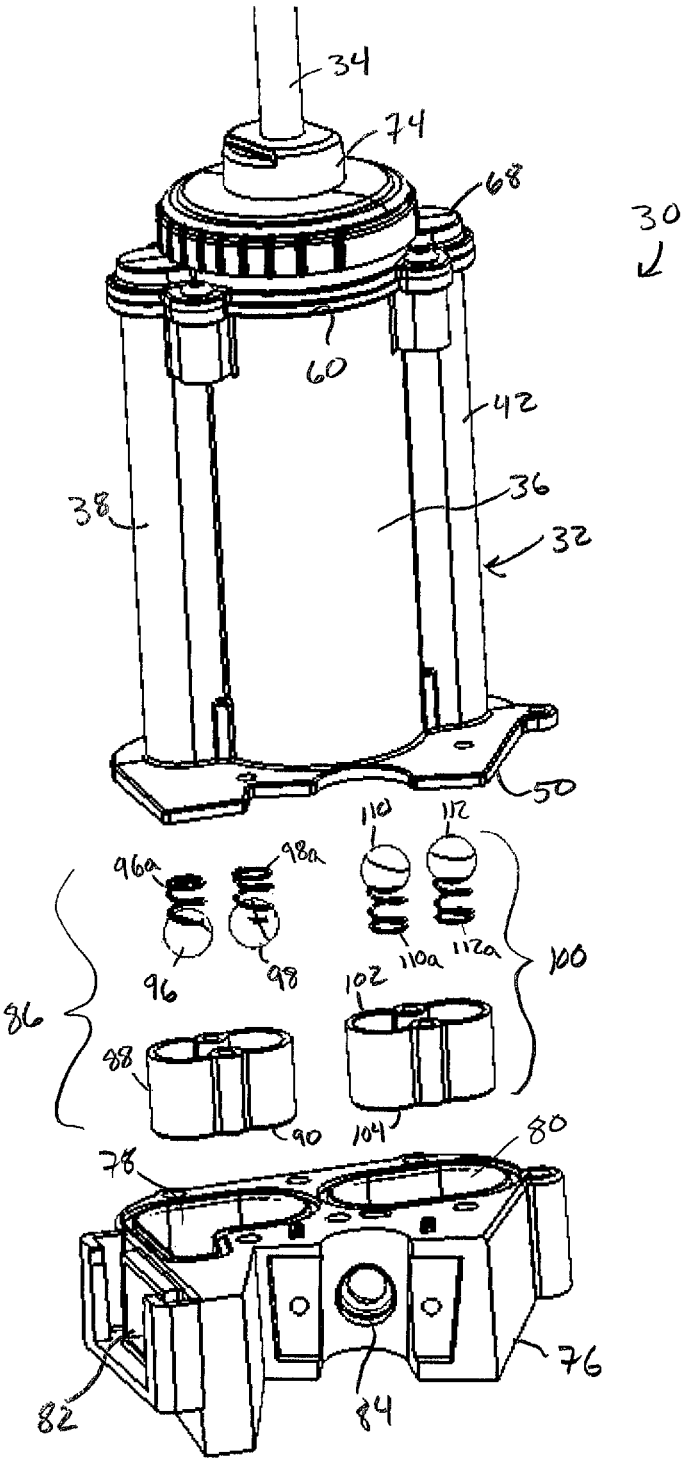
FIG. 6 is an exploded view of the double action pump unit shown in FIG. 5.

Pump manifold 76 is secured to bottom wall 50 of cylinder housing 36 and includes an inlet well 78 fluidly separated from an outlet well 80. Inlet well 78 includes an inlet orifice 82 in fluid communication with first tank 12 and outlet well 80 includes an outlet orifice 84 in fluid communication with second tank 14 (FIGS. 5 and 6). An inlet check valve assembly 86 is located within inlet well 78 and includes an inlet check valve housing 88 having a bottom wall 90 which includes an inlet tube well orifice 92 and cylinder inlet well orifice 94. An inlet tube check valve 96 is configured to interact with inlet tube orifice 52 and inlet tube well orifice 92 while a cylinder inlet check valve 98 is configured to interact with cylinder inlet orifice 56 and cylinder inlet well orifice 94. Similarly, an outlet check valve assembly 100 is located within outlet well 80 and includes an outlet check valve housing 102 having a bottom wall 104 which includes a cylinder outlet well orifice 106 and an outlet tube well orifice 108. A cylinder outlet check valve 110 is configured to interact with cylinder outlet orifice 58 and cylinder outlet well orifice 106 while an outlet tube check valve 112 is configured to interact with outlet tube orifice 54 and outlet tube well orifice 108. In accordance with an aspect of the invention, check valves 96, 98, 110 and 112 are ball valves. Each check valve may include a valve spring 96*a*, 98*a*, 110*a*, 112*a* coupled with a respective ball valve 96, 98, 110, 112. Valve springs 96*a*, 98*a* are configured to bias ball valves 96, 98 toward check valve housing bottom wall 90 while valve springs 110*a*, 112*a* are configured to bias ball valves 110, 112 toward cylinder housing 36.

Figure 7:
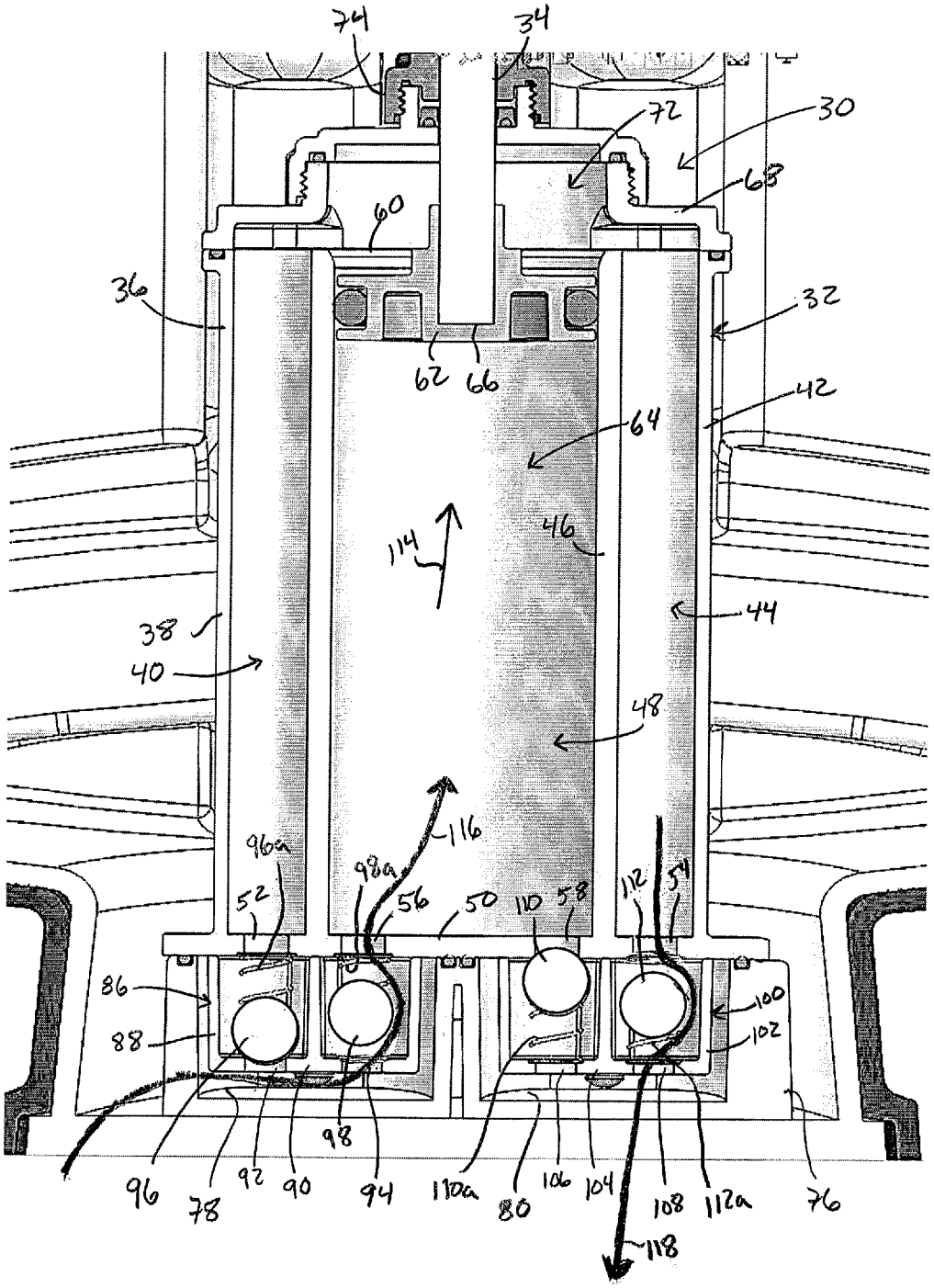
FIG. 7 is a cross section view of the double action pump unit shown in FIG. 5 following a piston up-stroke and immediately prior to a piston down-stroke.

As shown most clearly in FIG. 7, during an up-stroke of piston 62 within cylinder 48, as shown generally by arrow 114, fluid from first tank 12 is directed into first pressure chamber 64 while pressurized fluid within second pressure chamber 72 is discharged to second tank 14. To that end, upward travel of piston 62 creates a vacuum within cylinder 48 whereby cylinder outlet check valve 110 is drawn upwardly (with additional urging to the spring bias of valve spring 110*a*) to seat against cylinder outlet orifice 58 so as to close the check valve. Conversely, cylinder inlet check valve 98 is opened due to the vacuum overcoming the spring bias of valve spring 98*a* whereby fluid from first tank 12 is drawn under vacuum through inlet orifice 82 within pump manifold 76, cylinder inlet well orifice 94 and cylinder inlet orifice 56 as generally indicated by arrow 116. Simultaneously, upward travel of piston 62 (arrow 114) compresses fluid within second pressure chamber 72 such that the pressurized fluid travels downwardly within inlet tube 40 and outlet tube 44. The flow of pressurized fluid drives inlet tube check valve 96 downwardly (with additional urging to the spring bias of valve spring 96*a*) to seat against inlet tube well orifice 92 so as to close the check valve. Conversely, outlet tube check valve 112 is opened due to the downward pressure of the fluid overcoming the spring bias of valve spring 112*a* whereby the pressurized fluid within second pressure chamber 72 is discharged through outlet tube orifice 54, outlet tube well orifice 108 and outlet orifice 84 in pump manifold 76 to second tank 14 as generally indicated by arrow 118.

Figure 8:
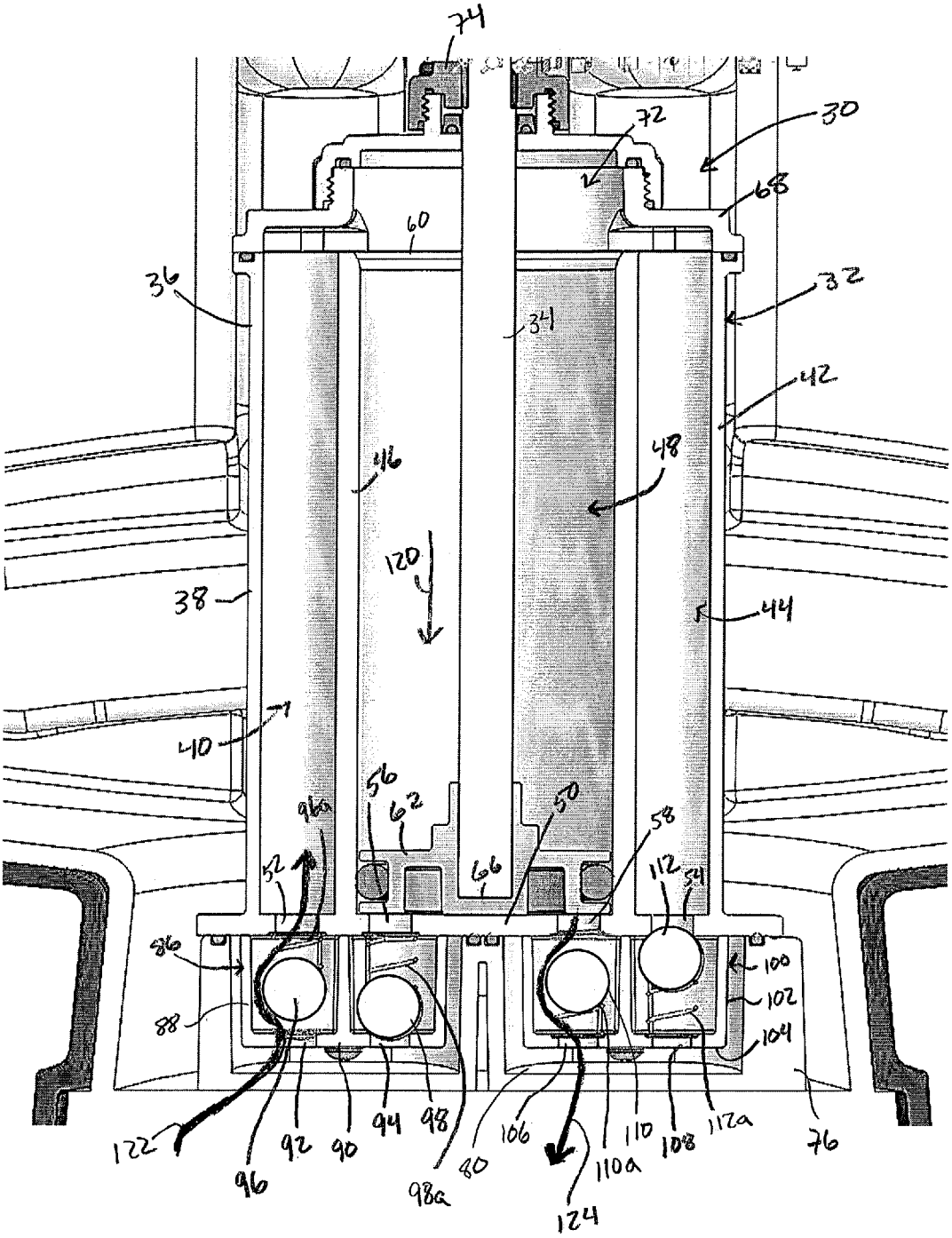
FIG. 8 is a cross section view of the double action pump unit shown in FIG. 5 following a piston down-stroke and immediately prior to a piston up-stroke.

With reference to FIG. 8, during a down-stroke of piston 62 within cylinder 48, as shown generally by arrow 120, fluid from first tank 12 is directed into second pressure chamber 72 while pressurized fluid within first pressure chamber 64 is discharged to second tank 14. To that end, downward travel of piston 62 creates a vacuum within second pressure chamber 72 such that outlet tube check valve 112 is drawn upwardly (with additional urging to the spring bias of valve spring 112*a*) to seat against outlet tube orifice 54 so as to close the check valve. Conversely, inlet tube check valve 96 is opened due to the vacuum overcoming the spring bias of valve spring 96*a* whereby fluid from first tank 12 is drawn under vacuum through inlet orifice 82 in pump manifold 76, inlet tube well orifice 92 and inlet tube orifice 52 as generally indicated by arrow 122. Simultaneously, downward travel of piston 62 (arrow 120) compresses fluid within cylinder 48. The flow of pressurized fluid drives cylinder inlet check valve 98 downwardly (with additional urging to the spring bias of valve spring 98*a*) to seat against cylinder inlet well orifice 94 so as to close the check valve. Conversely, cylinder outlet check valve 110 is opened due to the downward pressure of the fluid overcoming the spring bias of valve spring 110*a* whereby the pressurized fluid within first pressure chamber 64 is discharged through cylinder outlet orifice 58, cylinder outlet well orifice 94 and outlet orifice 84 in pump manifold 76 to second tank 14 as generally indicated by arrow 124.

In accordance with an aspect of the present invention, pump unit 30 may be a manually actuated pump with piston rod 34 pivotally coupled to a first end 126 of a translating rod 128 at piston rod second end 130. Second end 132 of translating rod 128 is coupled to a pump actuator, such as actuating rod 134. Actuating rod 134 may be selectively coupled to a handle 136 whereby movement of handle 136 in a first direction causes actuating rod 134 to rotate which translates translating rod 128 either upwardly or downwardly, which in turn drives piston rod in an opposing upward or downward movement whereby piston 62 engages in either a down-stroke (arrow 120) or an up-stroke (arrow 114). Movement of handle 136 in an opposing second direction reverses direction of movement of actuating rod 134, translating rod 128, piston rod 34 and piston 62 in the other of the down-stroke or up-stroke. Handle 136 may be mounted to either end 138, 140 of actuating rod 134 so as to enable left-handed or right-handed operation of pump unit 30.

In accordance with a further aspect of the present invention, translating rod 128 and actuating rod 134 may be located externally of first tank 12. Rear wall 12*a* of first tank 12 may also include a recess 12*b* wherein translating rod 128 may be positioned such that movement of translating rod 128 is not impeded by a user's body when backpack sprayer system 10 is worn against the back of the user. Additionally, while shown as described as a manually actuated pump, it should be noted by those skilled in the art that an electrically driven pump, such as but not limited to a battery powered pump, may also be employed, and that such pumps are to be considered within the teachings of the instant disclosure.

In accordance with a further aspect of the present invention, backpack sprayer system 10 may include an agitator within open internal volume 24 of first tank housing 22. As shown most clearly in FIGS. 3 and 4, one exemplary agitator may be a paddle 142, and more particularly a pair of paddles 142 mounted on respective arms 144 connected to a common yoke 146. Yoke 146 may be affixed to piston rod 34 such that upward and downward travel of piston rod 34, as described above, causes upward and downward travel of paddles 142. In this manner, paddles 142 may agitate fluid within first tank housing 22. Paddles 142 may be flat, continuous members, or may be a flat member including one or more apertures therethrough. Apertures may promote agitation by increasing fluid flow paths around and through the paddle, while also reducing compressive forces within the fluid as the paddles move through the fluid.

From the above description of pump unit 30, particularly in view of FIGS. 7 and 8, it should be noted that second tank 12 is filled with pressurized fluid upon each up-stroke and down-stroke of piston 62. Such operation is in contrast to pump systems generally used in the art of backpack sprayers. Typically, backpack sprayers employ pumps that charge the second tank only on one stroke, i.e., either the up-stroke or down-stroke, but not both. As a result, pump system 10 including a double action pump unit 30 can utilize a pump unit having a smaller footprint. That is, typical backpack sprayers may use pump units having cylinder diameters of approximately 2 inches. In accordance with an aspect of the present invention, cylinder 48 has a diameter of approximately 1.5 inches. Assuming 2 inches of piston travel per stroke, double action pump system 10 may still output approximately 25% more volume per stroke cycle (one up-stroke and one down-stroke) than a single action pump system using a larger cylinder. Moreover, the force required to drive a piston is proportional to the piston diameter. Thus, a piston with a larger diameter requires greater pumping force to drive the piston. Thus, in accordance with an aspect of the present invention, a 25% reduction in piston diameter (1.5 inches as opposed to 2 inches) leads to a greater than 50% reduction in required pumping force. As a result, less energy is required to drive pump system 10 as compared to generally available backpack spray systems. This reduction in required pumping force enables additional advantages. For example, when the pump unit is manually actuated, requiring less pumping force leads to less user fatigue. Further, the pressure volume may be charged with pressurized fluid having a higher pressure. That is, a lower pumping force allows the pump unit to discharge a greater volume of fluid into the fixed volume of the pressure vessel (more fluid within a fixed space yields higher fluid pressures).

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. An internal pump backpack sprayer system comprising:

a) a first tank including a tank housing defining an open internal volume configured to hold a fluid therein;

b) a second tank dimensioned to be received within said internal volume of said first tank and configured to receive a pressurized fluid therein; and c) a double action pump unit comprising a cylinder and piston assembly having a cylinder housing with first and second inlets and first and second outlets, and a piston located and moveable within a cylinder, wherein when said piston moves in an up-stroke, a first portion of said fluid is drawn from said first tank through said first inlet while said pressurized fluid is discharged to said second tank through said second outlet, and wherein when said piston moves in a down-stroke, a second portion of said fluid is drawn from said first tank through said second inlet while said pressurized fluid is discharged to said second tank through said first outlet.

2. The backpack sprayer system of claim 1 wherein said double action pump unit is received within said internal volume of said first tank, said pump unit being fluidly coupled to said first tank and said second tank, wherein said double action pump unit further includes a piston rod coupled to said piston at a first end of said piston rod, and wherein said cylinder and piston assembly comprises:

a) said cylinder housing having an inlet tube wall defining an inlet tube, an outlet tube wall defining an outlet tube, an inner cylinder wall defining a cylinder, and a bottom wall including an inlet tube orifice coinciding with said inlet tube, an outlet tube orifice coinciding with said outlet tube and a cylinder inlet orifice and cylinder outlet orifice coinciding with said cylinder, said cylinder housing having a top end located opposite said bottom wall;

b) a first pressure chamber is defined within said inner cylinder wall between said bottom wall of said cylinder housing and said piston;

c) a cylinder head located at said top end of said cylinder housing, wherein a second pressure chamber is defined within said inlet tube, said outlet tube and said inner cylinder wall between said piston and said cylinder head;

d) a pump manifold secured to said bottom wall of said cylinder housing, said pump manifold including an inlet well fluidly separated from an outlet well, wherein said inlet well includes an inlet orifice in fluid communication with said first tank and said outlet well includes an outlet orifice in fluid communication with said second tank;

e) an inlet check valve assembly located in said inlet well and including an inlet check valve housing defining said first and second inlets, an inlet tube check valve and a cylinder inlet check valve; and f) an outlet check valve assembly located in said outlet well and including an outlet check valve housing defining said first and second outlets, an outlet tube check valve and a cylinder outlet check valve; and wherein during said up-stroke of said piston within said cylinder, said inlet tube check valve and said cylinder outlet check valve are closed and said cylinder inlet check valve and said outlet tube check valve are open, whereby a vacuum is formed in said first pressure chamber to draw fluid from said first tank into said first pressure chamber through said inlet orifice in said pump manifold and said cylinder inlet orifice, and pressurized fluid within said second pressure chamber is discharged from said outlet tube to said second tank through said outlet tube orifice and said outlet orifice in said pump manifold, and wherein during said down-stroke of said piston within said cylinder, said inlet tube check valve and said cylinder outlet check valve are open and said cylinder inlet check valve and said outlet tube check valve are closed, whereby pressurized fluid within said first pressure chamber is discharged from said cylinder to said second tank through said cylinder outlet orifice and said outlet orifice in said pump manifold and a vacuum is formed in said second pressure chamber to draw fluid from said first tank into said second pressure chamber through said inlet orifice in said pump manifold and said inlet tube orifice.

3. The backpack sprayer system of claim 2 wherein said pump unit further includes a fluid agitator mounted on said piston rod.

4. The backpack sprayer system of claim 3 wherein said fluid agitator comprises one or more paddles and configured to reciprocally travel within said internal volume as said piston rod translates during said up-stroke and said down-stroke.

5. The backpack sprayer system of claim 2 wherein a translating rod is pivotally coupled to said piston rod, whereby translation of said translating rod in a first direction causes said piston to move in either said up-stroke or said down-stroke and whereby translation of said translating rod in an opposing second direction causes said piston to move in the other of said up-stroke or said down-stroke.

6. The backpack sprayer system of claim 5 wherein said translating rod is positioned external said first tank and is configured to translate within a recess defined within a back wall of said first tank.

7. An internal pump backpack sprayer system comprising:

a) a first tank including a tank housing defining an open internal volume configured to hold a fluid therein;

b) a second tank dimensioned to be received within said internal volume of said first tank and configured to receive a pressurized fluid therein;

c) a double action pump unit comprising a cylinder and piston assembly having a cylinder housing with first and second inlets and first and second outlets, and a piston located and moveable within a cylinder;

d) a piston rod having a first end coupled to said piston; and e) a translating rod pivotally coupled to a second end of said piston rod, wherein said translating rod is positioned external said first tank and is configured to translate within a recess defined within a back wall of said first tank, wherein translation of said translating rod in a first direction causes said piston to move in an up-stroke, whereby a first portion of said fluid is drawn from said first tank through said first inlet while said pressurized fluid is discharged to said second tank through said second outlet, and wherein translation of said translating rod in an opposing second direction causes said piston to move in a down-stroke, whereby a second portion of said fluid is drawn from said first tank through said second inlet while said pressurized fluid is discharged to said second tank through said first outlet.

8. The backpack sprayer system of claim 7 wherein said pump unit further includes a fluid agitator mounted on said piston rod.

9. The backpack sprayer system of claim 8 wherein said fluid agitator comprises one or more paddles and configured to reciprocally travel within said internal volume as said piston rod translates during said up-stroke and said down-stroke.

* * * * *